United States Patent [19]

Gyllenspetz et al.

[11] 4,054,494

[45] * Oct. 18, 1977

[54] COMPOSITIONS FOR USE IN CHROMIUM PLATING

[75] Inventors: Jeffrey Gyllenspetz, Knaresborough; Stanley Renton, Penkridge, both of England

[73] Assignee: Albright & Wilson Ltd., Warley, England

[ * ] Notice: The portion of the term of this patent subsequent to May 4, 1993, has been disclaimed.

[21] Appl. No.: 636,853

[22] Filed: Dec. 2, 1975

Related U.S. Application Data

[63] Continuation-in-part of Ser. No. 530,158, Dec. 6, 1974, Pat. No. 3,954,574.

[30] Foreign Application Priority Data

June 17, 1974 United Kingdom ..... 26665/74
Dec. 13, 1973 United Kingdom ..... 57872/73

[51] Int. Cl.[2] ..... C25D 3/06; C25D 3/56

[52] U.S. Cl. ..... 204/43 T; 204/43 R; 204/51

[58] Field of Search ..... 204/51, 43 R, 43 T

[56] References Cited

U.S. PATENT DOCUMENTS

| | | | |
|---|---|---|---|
| 1,564,414 | 12/1925 | Hoff | 204/50 Y |
| 2,458,839 | 1/1949 | Dyer et al. | 204/45 R |
| 3,108,933 | 10/1963 | Johnson | 204/51 |
| 3,954,574 | 5/1976 | Gyllenspetz et al. | 204/43 T |

*Primary Examiner*—G. L. Kaplan
*Attorney, Agent, or Firm*—Flynn & Frishauf

[57] ABSTRACT

It is known to attempt to plate chromium from a solution containing trivalent chromium salts and organic complexants. The invention provides an aqueous chromium electroplating system containing trivalent chromium together with both a formate or acetate and a bromide. Optionally the solution also contains ammonium, borate, chloride, sulphate and alkali metal ions and a wetting agent. The invention has the advantage of providing a solution with commercially acceptable covering and throwing power whose effluent can easily be purified to acceptable standards.

32 Claims, No Drawings

COMPOSITIONS FOR USE IN CHROMIUM PLATING

This application is a continuation-in-part application of Ser. No. 530,158 filed on Dec. 6, 1974, issued as U.S. Pat. No. 3,954,574 on May 4, 1976.

This invention relates to the electrodeposition of chromium from aqueous solutions of trivalent chromium salts.

Chromium electrodeposits have long been valued for their decorative appearance, strength and resistance to corrosion. However, of all the metals which are widely used in the electroplating industry, chromium is anomalous in that it is not possible, readily, to plate it from solutions of simple chromium salts.

Hitherto all commercial chromium plating has been carried out from solutions of hexavalent chromium, e.g. chromic acid plus catalyst. Owing to the toxicity of the spray produced and the unacceptability of hexavalent chromium to sewage or river authorities, it has been necessary to use expensive mist suppressants and to reduce Cr VI to Cr III before discharge, usually using sulphur dioxide. Moreover, due to the positive slope of the current density/plating thickness curve, more metal is deposited on high current density areas such as edges than is necessary for protection and, in certain cases, the fault called 'burning' appears (burning is deposition of Cr in a non-decorative, roughened, and non-bright form caused by excessive deposition rates).

For nearly a hundred years, therefore, numerous attempts have been made to develop an economically acceptable process for plating from solutions of trivalent and/or divalent chromium. Despite frequent claims to the contrary, especially in the patent literature, all these attempts have proved unacceptable in commercial practice. Systems for plating from trivalent chromium which have been proposed so far have had serious disadvantages such as inadequate covering or throwing power, instability or an effluent which is too difficult or costly to purify to the level required by sewage or water authorities.

A commercially acceptable plating solution must provide a more or less even deposit over the whole workpiece.

In practice the current density varies across the surface of the workpiece (e.g. between 5 and 1000 amps $ft^{-2}$.) The ability of a plating solution to produce bright deposits over a range of current density is called its covering power, the ability to deposit metal of even thickness at different current densities is called throwing power.

Conventional plating solutions based on hexavalent chromium have a covering power of about 5 to 800 amps $ft^{-2}$ and a rather poor throwing power as illustrated by the occurrence of 'burning' at high current densities.

Most trivalent chromium plating solutions which have been proposed hitherto have failed to provide sufficient covering or throwing power. For example, simple inorganic solutions, e.g. chloride or sulphate, show the characteristic of increasing deposition rate with increasing current density, leading to 'burning' at high current density areas and inability to plate into recessed areas unless the average current density is increased to a level at which unacceptable burning occurs on prominences. To overcome these disadvantages it has been proposed to form complexes (see for example U.S. Pat. No. 3,706,636).

One of the difficulties when using a complex of chromium, however, whether organic or inorganic in nature, is to achieve a complex which is stable and at the same time bound loosely enough to permit plating, and to enable chromium to be precipitated from rinse waters sufficiently readily to permit economic purification of the effluent. The solutions proposed in the prior art have always failed to fulfil one or more of the above conditions. Other practical difficulties such as low conductivity and generation of noxious anode products have also been found in certain cases.

We have now discovered a novel chromium electroplating solution which overcomes at least some of the foregoing difficulties, and which comprises (a) trivalent chromium, (b) formate or acetate (c) bromide and (d) at least 0.1 molar ammonium wherein the proportion of bromide may, for example be in the range 1:1 to 1:10 molar based on chromium. The solutions preferably contain at least 0.2 molar ammonium and preferably also borate.

Our invention provides, according to one aspect an aqueous solution containing: 0.1 to 1.2 molar trivalent chromium; at least 0.01 molar bromide; formate or acetate in a molar ratio of from 3:1 to 0.5:1 based on the chromium; at least 0.1 molar ammonium and at least 0.1 molar borate.

The solutions of our invention may optionally contain soluble amounts of other metallic ions which are codepositable with chromium to form alloys, such as iron, nickel, cobalt, manganese or tungsten. Preferably the solutions contain up to about 6 molar of conductivity salts. Preferably the pH of the solution is from 1 to 4.

The solution may contain bromide, formate (or acetate) and any borate ion which may be present, as the sole anion species, but such solutions are undesirably expensive. Preferably, therefore, the solution contains only sufficient bromide to prevent substantial formation of hexavalent chromium, sufficient formate to be effective in complexing the chromium and sufficient borate to be effective as a buffer, the remainder of the anions required to balance the cation content of the solution comprising cheaper species such as chloride and/or sulphate.

For example the solution optionally and preferably contains halide ions, in addition to bromide such as fluoride or, preferably, chloride. The total amount of halide including the bromide and any iodide which may be present as well as any fluoride, and/or chloride may optionally be sufficient, together with the formate and any borate to provide essentially the total anion content of the solution. The latter is determined by the number of equivalents of cation (including hydrogen ion) and is typically from 3 to 4 molar. Alternatively, and preferably, there may additionally be present some sulphate ion. Preferably the sulphate is present in a minor proportion based on the halide and most preferably a minor proportion based on the chloride and/or fluoride. Alternatively the sulphate may comprise a major proportion of the inorganic ion and, less preferably, may be present in place of chloride and fluoride. Preferably the solution also contains alkali metal ions, usually provided as the cations of the conductivity salts, and/or of some or all of the salts used to introduce the anion species, which alkali metals are preferably sodium or potassium. The solution may also contain alkaline earth metals such as calcium or magnesium.

The solutions of our invention may additionally contain minor, compatible amounts of additives, such as wetting agents (e.g. alkali metal alkyl benzene sulphonates) or antifoams which are commonly used in plating technology.

Our novel solutions therefore comprise at least some of the following species:

A. Trivalent chromium

This is an essential ingredient of the solutions of the invention. Proportions of less than 0.1 molar or more than 1.2 molar trivalent chromium result in significant loss of covering power, and the concentration should therefore be maintained within these limits, and preferably between 0.2 and 0.6 molar. Preferably the solution is substantially free from hexavalent chromium and preferably the chromium in the solution is substantially all present as trivalent chromium before plating.

B. Bromide

This is an essential ingredient. The concentration of bromide should be maintained above 0.01 molar, to avoid formation of hexavalent chromium, and lowering of the plating rate. The maximum concentration is not critical but, is typically less than 4 molar and preferably less than 1 molar. Economic and effective operation normally requires a concentration of bromide between 0.05 and 0.5. The preferred range is from 0.05 to 0.3 molar. Best results are obtained when the concentration of bromide is greater than 0.1 molar. Iodide functions in a similar fashion to bromide, but suffers the disadvantage that free iodine, which would be formed during plating is only soluble to the extent of 0.03% w/w in water compared with 4% for bromine. Consequently attempts to use iodide in place of bromide lead to unacceptable precipitation of iodine. Iodide is, moreover, too expensive to use economically in place of bromide. However, it is possible, in principle, to replace a minor part of the bromide with iodide, and references herein to bromide do not exclude bromide containing traces of iodide.

C. Formate and/or acetate

This is essential ingredient, formate being strongly preferred. Typically the proportion of formate to chromium should not exceed 3:1 on a molar basis, to avoid unacceptedly severe precipitation of the corresponding chromium salt. If the proportion is less than 0.5:1 the covering power is undesirably reduced. Preferably the proportion of formate to chromium is between 2:1 and 1:1. Acetate functions similarly to formate but is very much less effective since the plating rate is much lower. Acetate is not as effective as formate in preventing the accumulation of free halogen. It is possible to use acetate as a partial replacement for formate up to about a third of the total weight of carboxylic acid without serious adverse effect. Solutions containing acetate as more than a third of the total carboxylic acid are unlikely to be commercially competitive with solutions based on formate alone, although they are superior to prior art methods.

D. Ammonium

The presence of ammonium is essential for our invention. Generally if the concentration of ammonium is less than 0.1 molar, there is a risk of forming hexavalent chromium. The upper limit is not critical and ammonium may be present in amounts up to saturation, i.e. about 4 molar. Preferably the ammonium is present in a concentration of at least 0.2 molar, most preferably from 1 to 3 molar. These higher concentrations are desirable because deposits tend to be darker at ammonia concentrations near the minimum and also because the presence of ammonium helps to reduce consumption of formate. Both ammonium and formate contribute to preventing the buildup of free bromine, but at higher ammonium concentration, the proportion of ammonium oxidized in this reaction is greater, with consequent economies in the more expensive formate. It is also possible within the scope of this invention to include some substituted ammonium compounds such as hydroxylamine, hydrazonium or alkylammonium in the compositions. However, in the absence of ammonium itself they do not provide adequate covering power. Preferably arylammonium or heterocyclic ions such as pyridinium are absent since they tend to inhibit deposition of chromium.

E. Borate

Although it is possible to plate chromium from solutions of our invention which do not contain borate, we have not been able to obtain what we consider fully satisfactory results, commercially, in the absence of borate. Concentrations below 0.1 molar result in undesirably low covering power. The upper limit is not critical and is determined only by the solubility of borate in the system, but generally we prefer to employ from 0.5 to 1 molar borate. The function of the borate is obscure. Its beneficial effects may be in part due to its buffering action. However, other buffer salts, such as phosphates and citrates appear relatively ineffective.

F. Conductivity salts

These are optional but preferred. The concentration is not critical and may vary between zero and about 6 molar according to solubility. Preferably they are present in proportions between 0.5 and 5 molar, e.g. 1 to 4 molar. Conductivity salts is a term used in the plating art to denote certain readily ionisable salts which may be added to plating baths to increase their electrical conductivity and so reduce the amount of power dissipated in the bath. Typically they are alkali metal or alkaline earth metal salts of strong acids which are soluble in the solution. They should have a dissociation constant at least equal to $10^{-2}$. Typical examples are the chlorides and sulphates of sodium and potassium.

G. Hydrogen Ion

Best results are obtained when the bath is somewhat acidic. At low pH values (below 2) there is some loss of covering power which becomes unacceptable below pH 1. If the pH is above 4 the rate of plating tends to be undesirably slow. Optimum pH is between 2 and 3.5.

H. Chloride and/or Fluoride

This is optional, but in the case of chloride, preferred. The amount is not, however, critical. It may vary from zero up to the maximum permitted by solubility considerations. Chloride is generally introduced into the bath as the anion of the conductivity salt (e.g. sodium chloride), as ammonium chloride, which is a convenient means of introducing the ammonia requirement of the bath, as chromic chloride which may optionally be used to supply at least part of the chromium requirement, and/or as hydrochloric acid, which is a convenient means of adjusting the pH of the bath. Preferably the chloride content is at least 0.5 molar most preferably at least 1 molar e.g. 1.5 to 5 molar. A particulary convenient range is 2 to 3.5 molar.

I. Sulphate

Is an optional but preferred ingredient. The amount of sulphate is not critical and may, like that of the chloride, vary between zero and maximum amount which is compatible with the solution. In one type of bath, particularly preferred, the amount of sulphate is less that the total halide, and preferably less than the total chloride. In a different type of bath, however, the proportion of sulphate is greater than the proportion of halide, and may be the predominant anion in the bath. Like the chloride, the sulphate may be introduced into the bath as the anion of the conductivity salt, or of the ammonium of chromium salts or as sulphuric acid. Typical sulphate concentrations may be between 0 and 5 molar preferably 0.5 to 4, e.g. 0.6 to 3, most preferably 0.6 to 1.2 molar. Preferably the combined chloride and sulphate concentrations are at least 1 molar, e.g. at least 2 molar most preferably from 2.5 to 3.5molar.

J. Co-depositable metal

Iron may be present as an optional ingredient of the bath when it is desired to plate chromium alloys. It may be present in the bath in any amount up to saturation, depending upon the desired composition of the alloy to be plated. It is normally introduced as its soluble chloride or sulphate.

K. Non co-depositable metals

These are optionally but preferably present. In particular sodium and/or potassium are preferably present in a proportion of at least 0.5 molar up to 4 or 5 molar according to solubility. The presence of sodium and/or potassium helps the conductivity of the solution and also improves the throwing power. Typically the sodium and/or potassium are added in a proportion of about 2 molar initially, but tend to accumulate during use so that the concentration may rise up to saturation value. Other alkali metals such as lithium, alkaline earth metals such as calcium or magnesium or other metal ions which will not plate out of the solution with the chromium may also be present. The amount of such metals is not critical provided that they do not precipitate in the presence of the other components. They are generally present incidentally, as the cation species of the conductivity salt, or of the borate, formate and/or bromide salts which may be used to provide those anions species in the solution.

L. Surface active agents

These are optionally but preferably present in effective and compatible amounts. Wetting agents and antifoams are used throughout plating technology and many suitable examples are well known to those skilled in the art. Any of the wetting agents commonly used in hexavalent chromium plating may be used in the present invention. However, since the solutions of the present invention are much less strongly oxidising than hexavalent chromium solutions it is also possible, and preferred, to use the cheaper wetting agents commonly employed in the less agressive types of plating solution. The principal restriction on the effectiveness of the wetting agents arises from the presence of free bromine in the solution. Surfactants which are liable to bromination are therefore not recommended e.g. most non-ionic surfactants. The surfactants used according to our invention are typically cationic such as those described in B. Pat. No. 1,368,749 or preferably anionic e.g. sulphosuccinates, alkyl benzene sulphonates having from 8 to 20 aliphatic carbon atoms, such as sodium dodecyl benzene sulphonate, alkyl sulphates having from 8 to 20 carbon atoms such as sodium lauryl sulphate and alkyl ether sulphates such as sodium lauryl polyethoxy sulphates. If the solution has undesirable foaming tendencies it is also possible, optionally, to include compatible antifoams e.g. fatty alcohols such as octyl alcohol. The choice of surfactants for use in our solution is a routine matter easily within the ordinary competence of those skilled in the art. The amount of wetting agent used is in accordance with normal practice, e.g. 0.1 to 10 parts per thousand.

It is preferred that the solutions of our invention should consist essentially of the foregoing species. However, we do not exclude the presence of minor amounts of other species which are compatible with the solutions and which do not adversely affect the plating properties to a material extent. Generally it is preferred that nitrate ion be substantially absent, since it tends to inhibit deposition of chromium, but other species, organic or inorganic, which do not inhibit plating of the chromium or materially reduce covering power or create unacceptable problems of toxicity, may optionally be present. Whether any particular species can be tolerated in the solution may be routinely determined by simple testing.

The bath may conveniently be made up by dissolving water soluble salts of the required species in water in an amount sufficient to provide the desired concentration. Typical salts which may be used include chromic chloride chromic sulphate, potassium bromide, sodium bromide, ammonium bromide, ammonium formate, potassium formate, sodium borate, ammonium chloride, ammonium sulphate and sodium chloride.

The cationic species may, if desired be added wholly or partly as bases such as, for example, aqueous ammonia. A particularly convenient form of chromium is basic chromium sulphate, which is commercially available in chrome tanning liquors. For example a 33% basic chromium sulphate, obtained by reducing sodium dichromate with sulphur dioxide is a common article of commerce, and a particular advantage of the invention is that it is possible to use such relatively cheap and readily available sources of chromium. However, we do not exclude the use of salts such as chromium formate or acetate. We do not exclude the use of a preformed complex of chromium with bromide and formate, analogous to those described in U.S. Pat. No. 3,729,392, however such complexes are much less preferred than simple mixtures of the salts, which are considerably less expensive.

The anion species may be added, at least in part as acids. Preferably, when the essential species have been dissolved, the pH may be adjusted by addition of, for example, hydrochloric or sulphuric acid, or of, for example, ammonium, sodium or potassium hydroxide. Preferably the pH is initially adjusted in the upper part of the preferred range, e.g. 2.5 to 4. In the use the pH tends to fall and should be maintained, by occasional adjustments, in the range 2.5 to 3.5 e.g. 2.7 to 2.8.

According to a further embodiment of the invention there are provided replenishing compositions which may conveniently be used in the preparation and maintenance of trivalent chromium electroplating baths and which consist essentially of: (A) borate ions in the form of boric acid or an alkali metal or ammonium borate, (B) at least one alkali metal chloride, fluoride or sulphate, (C) bromide present as alkali metal or ammonium bromides, and (D) ammonium present as ammonium borate, chloride, bromide or sulphate.

According to a further aspect of our invention the aforesaid composition of the invention, may optionally include not more than two members selected from the group consisting of trivalent chromium, formate and water.

The composition of our invention may also, optionally, include a wetting agent.

Borate is preferably present in the aforesaid replenishing compositions of our invention as boric acid. However alkali metal or ammonium borates such as the orthoborates, metal borates or pyroborates of sodium or potassium may be used. The proportion of borate is at least 1% (measured as $H_3BO_3$) of the weight of the four essential ingredients of the replenishing composition, typically from 2 to 40% preferably 10 to 30%, most preferably 15 to 25% e.g. 20%.

Bromide is preferably present in our replenishing compositions as ammonium bromide. Alternatively it may be present as an alkali metal bromide e.g. sodium or potassium bromide. Bromide should be present in a proportion, measured as HBr, of at least 0.5% of the total weight of the four essential ingredients of the replenishing composition, typically 1 to 20%, preferably 1.5 to 10%, most preferably 2 to 5% e.g. 3 to 4%.

The alkali metal salt is preferably a sodium or potassium salt and is preferably present as sodium chloride. Alternatively it may be present as sodium or potassium fluoride, sodium or potassium sulphate or as potassium chloride or any mixture of the above salts. The alkali metal salt is usually present in a proportion of at least 2% of the dry weight of the replenishing composition, typically 5 to 60%, preferably 10 to 50% most preferably 20 to 40%, e.g. 30 to 36%.

The ammonium is preferably present in our replenishing composition partly as the cation of the bromide and partly as ammonium chloride. Alternatively or additionally it may be present as ammonium sulphate. Part of the ammonium may optionally be present as ammonium formate. Usually the mixture contains from 5 to 80% of ammonium salt based on the total weight of the four essential components of the mixture, typically 10 to 70%, preferably 20 to 60%, most preferably 30 to 50% e.g. 35 to 45%. Usually the proportion of ammonium to alkali metal is from 1:2 to 3:1 on a molar basis, preferably 1:1 or 2:1 e.g. 1.4:1 to 1.6:1.

Optionally the replenishing compositions of our invention may contain formate. This is usually present as ammonium formate, but may optionally be present as an alkali metal or trivalent chromium salt, e.g. sodium formate, chromic formate or potassium formate.

The proportion of formate may vary, depending upon the conditions of operation of the bath to be replenished. The formate is consumed in the operation of the bath, and consequently may require to be added to the electroplating bath in greater total quantities, and preferably at most frequent intervals than most of the essential components of the replenishing composition of our invention, which are lost from the bath primarily by drag-out. Consequently it may often be preferable to supply the formate requirement of the bath by means of separate additions of formate, rather than by including formate in the replenishing compositions of our invention in a proportion sufficient to provide a complete replacement for the formate lost. It is possible, however, to provide a part of the formate requirement of the bath by means of the replenishing compositions of our invention, supplemented by extra additions of formate. It follows that the formate content of the replenishing compositions of our invention may be varied within wide limits, from 0 to over 60% of the total weight of the composition.

Chromium may optionally be present in the replenishing compositions our invention, in the trivalent state. The compositions are substantially free from hexavalent chromium. The chromium may be present as a chromic halide, such as chromic chloride, or less preferably chromic fluoride or chromic bromide, as chromic formate or, preferably as chromic sulphate. A particularly convenient source of chromium is chrome tanning liquor, which is an aqueous solution of basic chromic sulphate. However, aqueous chromic salts are preferably not included in compositions of our invention in conjunction with formate, as explained in more detail below.

Chromium, like formate, is consumed when the bath is in use. It may therefore be added to the bath at substantially more frequent intervals than the replenishing compositions of our invention. Moreover the rate of consumption of chromium differs from that of formate and both may vary in relation to the rate of use of the non-consumed components, depending upon the conditions of operation of the bath. For these reasons it is preferred to add the chromic salts to the bath separately from the replenishing compositions of the present invention. However, as in the case of formate the chromic slats may be added to the bath partly with the replenishing compositions of our invention partly by supplementary additions where required. The proportion may therefore be varied widely between 0 and 70% by weight of the composition.

The replenishing compositions of our invention are preferably solid mixtures. However, provided that they do not contain both chromium and formate, they may be in the form of aqueous solutions. Aqueous solutions comprising trivalent chromium and formate are often unstable unless the proportion of formate to chromium is substantially lower than is desirable when the bath is initially prepared. This problem arises because the separate ingredients do not initially provide satisfactory deposition of chromium. However on plating out for a short period from a bath containing a high proportion of formate, a complex of chromium is formed in situ, which provides excellent plating characteristics. We have found that this complex is only formed in an acceptable time if the proportion of formate is high. Once the complex formed it is possible to use the bath commercially, whereupon the excess formate is rapidly consumed to provide a stable solution. Stability is also adversely affected by the presence of a high proportion of sodium.

For the foregoing reasons we prefer not to include formate, chromium and water in the replenishing compositions of our invention. However according to a special embodiment of the invention, the complex may be preformed by heating the chromium with the formate and halides, in solution. Such a preformed complex may be included in an aqueous composition of the invention.

When water is present in the replenishing composition of the invention it is preferably present in at least a sufficient proportion to dissolve substantially all the components of the composition. While it is preferred to have a sufficient excess of water, over the minimum required to dissolve the composition, to ensure that the solution is stable to normal fluctuations in the ambient temperature, there is an obvious disadvantage in having too much water, since it increases the cost of storage and transport of the composition. It is preferred therefore, if water is present to employ the minimum quantity consistent with a reasonably stable solution. In any case, the solution should preferably, of course, not be any less concentrated with respect to any of the essential components than the bath it is designed to provide or to maintain.

Thus, for example, an aqueous replenishing composition according to our invention may be substantially saturated with respect to any of the components, but should, preferably, not contain less than 0.1 molar ammonium, more preferably not less than 0.2 molar ammonium, most preferably not less than 1 molar ammonium e.g. not less than 3 molar ammonium. Similarly the solution should, preferably, contain at least 0.01 molar bromide, more preferably, at least 0.05 molar, most preferably, at least 0.1 molar, e.g. at least 0.3 molar; borate is, preferably at least 0.1 molar, most preferably at least 0.5 molar, e.g. at least 1 molar; and alkali metal is preferably at least 0.5 molar, most preferably at least 1 molar, e.g. at least 2 molar.

It is, of course, possible to depart from the above stipulated minimum concentrations, if the deficient component is supplied to the bath by separate additions: e.g., in the case of ammonium, a part of the ammonium may be supplied in separate additions as ammonium formate. In other cases, however, e.g. borate, the making of separate additions would detract from one of the major advantages of this aspect of the present invention, which is the possibility of simultaneously supplying to the bath a plurality of components, which, we have discovered, are lost at a common rate, in a single addition, reducing the need to analyse for each component separately and make separate adjustments for each.

The compositions of our invention may optionally contain a wetting agent or similar surfactant substance. Typically, if present, surfactants may be included in proportions of, for example, from 0.01% by weight of the total of the essential components of the composition, up to 5%. However the surfactant should in practice be replenished with great frequency. It is inconvenient to add the surfactant solely as part of the replenishing compositions of the invention and it is generally preferred to add all the surfactant separately to the bath.

Preferably the replenishing compositions of the invention are substantially free from species other than those specified above. In particular nitrate, is preferably substantially absent, since it tends to inhibit plating, similarly, hexavalent chromium is preferably absent. Sulphite has been found to cause a hazy finish if present in the final bath in more than traces. Preferably sulphite too is substantially absent.

According to a further embodiment, our invention comprises the use of the aforesaid replenishing compositions of the invention for preparing or maintaining trivalent chromium electroplating baths. The preparation preferably comprises dissolving or diluting the composition with water to the desired concentration and before, during or after mixing the composition with the water, introducing trivalent chromium salt and formate and adjusting the pH.

As previously described, the amount of formate added initially is preferably in excess of that required for a stable solution. Typically, it may initially be present in an excess of 2 moles per mole of chromium. After an initial period of plating on cathode sheets a complex is formed whch permits high quality plating of commercial work. Subsequent commercial plating reduces the formate level below 2 moles per mole of chromium, and a stable solution is obtained.

If plating is not commenced within about 48 hours there is a tendency for precipitates to form. Preferably plating is commenced as soon as practicable after the installation of the bath, typically within 12 hours and more preferably within 8 hours or less. The bath is generally suitable for commercial operations after 1/2 ampere hour per liter. Typically a current of 1/2 ampere per liter is passed through the bath for up to 1 hour, at ambient temperature. If the bath is prepared at more elevated temperatures it is possible to reduce the initial plating out period. For example at 30° C only 1/4 ampere hour per liter is required, while at 70° C it may be possible to dispense with the initial plating out altogether.

Once the initial plating out has been completed, commercial work pieces may be introduced into the bath and plated normally. After about 20 ampere hours per liter the concentration of formate is reduced to a stable value. The stable concentration of formate is dependent upon the concentration of chromium and the concentration of alkali metal. In a typical composition containing 0.38 molar chromium the solution is stable when the formate concentration has reduced to 0.71 molar or less.

Preferably the bath is made up from an aqueous basic chromic sulphate, ammonium formate, a dry solid replenishing composition according to our invention comprising the four essential ingredients, and separate additions of water and wetting agent. The composition is then adjusted to the desired pH, usually between 1 and 4, using, for example, hydrochloric acid and/or aqueous ammonia. Since the pH tends to fall during use, it is preferred to adjust it to the upper point of the range, e.g. 2.5 to 4.

According to a further embodiment of our invention there is provided a method for the maintenance of a trivalent electroplating bath which comprises the step of adding thereto, from time to time, a replenishing composition of the present invention in an amount sufficient to restore the quantity of borate and bromide therein to substantially its desired level.

Preferably maintenance comprises adding to the bath: (a) a chromic salt, e.g. aqueous basic chromic sulphate in an amount sufficient to replace chromium losses; (b) a formate, preferbly ammonium formate, in an amount sufficient to replace formate losses; (c) a composition of our invention in an amount sufficient to replace losses of either of the constituents borate or bromide; (d) a wetting agent at a rate sufficient to maintain an effective amount thereof; (e) water as necessary to maintain the concentration of the bath; and (f) a base, e.g. aqueous ammonia to prevent the pH falling outside the preferred range.

Preferably each of the above additions is made independently at a rate sufficient to prevent the concentration of the relevant species from passing outside the preferred ranges specified in our aforesaid copending Application.

The solution is preferably used at temperatures between 15° and 30° C e.g. 20° to 25° C. Current densities between 5 and 1000 amps $ft^{-2}$ typically between 50 to 500, may be employed. Preferably the mean current density is between 80 and 300 e.g. about 100 amps $ft^{-2}$. Unlike hexavalent chromium plating solutions, in which the current efficiency remains substantially constant at different current densities, our novel solutions have a current efficiency which falls with increasing current density. Thus whereas hexavalent chromium solutions give a sharply increasing thickness of deposit with increasing current density, which makes it difficult or impossible to plate into recessed areas without excessive deposition, or "burning" of exposed edges or raised portions, our novel solutions according to this invention give a relatively even thickness of deposit over a wide range of current densities and thereby permit chromium plating on various complex shapes which could not previously be satisfactorily plated from hexavalent chromium solutions. Typically the plating rate is between 3 and 5 micro inches per minute at average anode current densities of 100 amps $ft^{-2}$.

It is preferred when electroplating from solutions of our invention to use inert anodes such as, for example, carbon anodes. Other inert anodes such as platinised titanium or platinum may be used but are more costly. Soluble chromium anodes are unsuitable due to the build up of hexavalent chromium. However, for alloy plating it is possible to use, for example, ferrous metal or chrome/iron anodes.

The invention will be illustrated by the following examples:

EXAMPLE 1

A solution was prepared by dissolving the following ingredients in water and then diluting the resultant solution to 1 liter.

| | | Molar Quantities |
|---|---|---|
| 1. Chromic chloride | 140 ml of a solution containing 150 g/l Cr | 0.4 Cr |
| 2. A dry mixture of: | | |
| Potassium formate | 80 g | 1.0 $HCOO^-$ |
| Ammonium bromide | 10 g | 0.1 Br |
| Potassium chloride | 76 g | 1.0 KCl |
| Boric acid and | 40 g | 0.66 $H_3BO_3$ |
| Ammonium chloride | 54 g | 1.0 $NH_4Cl$ |
| 3. Proprietary Wetting agent | 1 ml | |

The wetting agent was a mixture of a sodium sulphosuccinate and a minor proportion of octyl alcohol, to reduce foaming.

The equilibrium pH of the solution after standing for 24 hours was 2.8.

After standing overnight, the solution was placed in a conventional Hull Cell furnished with circulatory cooling and plated using a carbon anode. The following results were obtained by plating for three minutes at a total current of 5 amps and a temperature of 25°

| Current density Amps/sq ft (ASF) | 400 | 200 | 100 | 50 | 25 |
|---|---|---|---|---|---|
| Thickness of deposit in micro inches | 18 | 15 | 17 | 13 | 5 |

The bright plating range extended to the high current density end of the panel and was estimated as having an upper value of at least 1000 ASF and the minimum deposition current density cut-off was measured as less than 5 ASF. After the passage of 20 AH/Liter, no deterioration in plating was noted and only a minor variation in pH was recorded.

Raising the pH of the used electrolyte to 8 by addition of alkali resulted in the chromium content of the electrolyte being immediately precipitated.

EXAMPLE 2

| | |
|---|---|
| Ammonium chloride | 90 g |
| Potassium chloride | 75 g |
| Ammonium bromide | 10 g |
| Boric acid | 50 g |

The above composition was dissolved in water at laboratory temperature together with 55 gm ammonium formate, 150 mls chromium tanning liquor, 1 ml wetting agent and 2 mls sulphuric acid S.G. 1.84 and the solution was diluted to 1 liter.

The chromium tanning liquor used in this experiment was a 33% basic liquor. This is an article of commerce used for tanning of leather and is made by reduction of sodium dichromate with sulphur dioxide. The reaction has a 'basicity' of 33%, 'basicity' being a measure of the replacement of sulphate by hydroxyl to give products of varying composition. The liquor contained 130 g/l Cr.

The pH at makeup was 3.4 and plating with a carbon anode was commenced within 30 minutes at a volume current density of 0.5 amp/liter. After 1 hour plating (i.e. after 0.5 ampere hour per liter), a sample was taken for evaluation in a Hull Cell furnished with circulatory cooling to maintain temperature between 20°-25° C.

A current 10 amps was passed for 3 minutes using a carbon anode and the following distribution on the panel was recorded by standard coulometric thickness measurements.

| Current density (amps/sq ft ASF) | 400 | 200 | 100 | 50 | 25 |
|---|---|---|---|---|---|
| Thickness in micro inches | 12 | 8 | 6 | 8 | 4 |

The plating range was estimated at 1000 - 8 ASF at the working pH of 3.0.

Further plating was carried out from the solution for a total of 20 ampere hours to provide a stable bath composition.

The bath was used regularly for plating over a period of 3 weeks and was maintained by regular additions of the aforesaid composition in an amount sufficient to maintain the concentration of the borate in the solution at a level of 0.8 molar, sufficient chromium tanning liquor to maintain the concentration of chromium at 0.38 molar and sufficient ammonium formate to maintain the concentration of formate at 0.7 molar. The pH of the bath was maintained in the range 2.5 to 3.0 by periodic additions of aqueous ammonium hydroxide.

EXAMPLE 3

A solution was prepared by dissolving the following ingredients in water and heating to 60° C, allowing to cool overnight and making up to 1 liter.

| | g | Approx. Molar |
|---|---|---|
| Chromic fluoride | 42 | 0.4 M |
| Potassium chloride | 50 | 0.7 M |
| Ammonium chloride | 100 | 2 M |
| Ammonium bromide | 10 | 0.1 M |
| Boric acid | 50 | 0.8 M |

-continued

| | g | Approx. Molar |
|---|---|---|
| Sodium formate | 60 | 0.88 M |

The plating range was estimated at 1000 - 30 ASF at pH 3.15.

EXAMPLE 4

A solution containing iron was prepared from a solution as described in Ex. 1 by adding 14 g ferrous chloride ($FeCl_2 4H_2O$). Similar plating tests carried out on a Hull Cell gave a deposit with a plating range of 10 - 800 ASF at pH 3.5. The deposit consisted of an iron chromium alloy containing 40 - 60% Fe + 60–40% Cr and was non-rusting in air.

EXAMPLE 5

A zinc diecast lock plate was plated conventionally with copper and duplex nickel to BS 1224 Service Condition 3, and finished by plating with 25 millionths of an inch of chromium from the electrolyte of Ex. 1 at about 100 ASF. No special precautions were taken in jigging, and no 'burners' or other current-robbing devices were used. No difficulty was found in plating the whole surface without 'burning' or loss of cover.

The deposit, when examined after overplating with copper as in BS 1224 Appendix E2, showed microcracking over the whole surface at a density of approx. 2000 cracks per inch, forming a closed network. The corrosion resistance of a similar sample exposed in a 'CASS' test (BS 1224 Appendix H) was good and fully equivalent to a proprietary microcracked chromium plated from a chromic acid base solution.

We claim:

1. An aqueous chromium electroplating solution consisting essentially of from 0.1 to 1.2 molar trivalent chromium; at least 0.1 molar bromide; formate in a proportion of from 3 to 0.5 moles per mole of the chromium; at least 0.1 molar ammonium and at least 0.1 molar borate.

2. The solution of claim 1 wherein the concentration of chromium is from 0.2 to 0.6 molar.

3. The solution of claim 1 wherein the concentration of bromide is less than 1 molar.

4. The solution of claim 3 wherein the concentration of bromide is from 0.1 to 0.3 molar.

5. The solution of claim 1 wherein the proportion of formate is between 2 and 1 moles per mole of chromium.

6. The solution of claim 1 wherein the concentration of ammonium is from 1 to 3 molar.

7. The solution of claim 1 wherein the concentration of borate is from 0.5 to 1 molar.

8. The solution of claim 1 containing up to 6 molar of conductivity salts.

9. The solution of claim 1 containing from 1 to 5 moles of alkali metal ions selected from the group consisting of sodium and potassium ions.

10. The solution of claim 1 having a pH between 1 and 4.

11. The solution of claim 1 containing at least 0.5 molar of halide selected from chloride and fluoride.

12. The solution of claim 11 containing from 1.5 to 5 molar chloride.

13. The solution of claim 1 containing up to 3 molar sulphate.

14. The solution of claim 1 containing from 0.5 to 4 molar sulphate.

15. The solution of claim 1 having a pH from 1 to 4 and containing from 1.5 to 5 molar chloride and at least 0.5 molar sulphate the proportion of sulphate being smaller than the proportion of chloride.

16. An aqueous chromium electroplating solution consisting essentially of from 0.1 to 1.2 molar trivalent chromium; from 0.05 to 0.3 molar bromide; from 2 to 1 moles formate per mole of chromium; from 1 to 3 molar ammonium; from 0.5 to 1 molar borate; and from 1 to 5 moles per liter of alkali metal ions selected from sodium and potassium.

17. The solution of claim 16 containing from 2 to 4 moles per liter of said alkali metal ions.

18. The solution of claim 16 having a pH between 1 and 4.

19. The solution of claim 16 having a pH between 2 and 3.5.

20. The solution of claim 16 having a pH of from 1 to 4 and containing from 0.5 to 4 molar sulphate and at least 0.5 molar chloride the proportion of chloride being less than the proportion of sulphate.

21. The solution of claim 16 having a pH of from 1 to 4 and containing from 2.5 to 3.5 molar total of anion selected from chloride and sulphate.

22. An aqueous chromium electroplating bath consisting essentially of water, from 0.2 to 0.6 molar trivalent chromium, from 0.05 to 0.3 molar bromide, from 2 to 1 moles formate per mole of trivalent chromium, from 0.2 to 3 molar ammonium, from 0.5 to 1 molar borate, from 2 to 4 molar total of anions selected from chloride and sulphate including at least 0.5 molar chloride and at least 0.5 molar sulphate and from 2 molar to saturation of alkali metal cations selected from the group consisting of sodium and potassium, and having a pH between 1 and 4.

23. The solution of claim 22 containing from 1 to 3 molar ammonium and at least 2 molar chloride.

24. The solution of claim 22 containing an effective and compatible amount of a cationic wetting agent.

25. The solution of claim 22 containing an effective and compatible amount of an anionic wetting agent.

26. A method for the preparation of trivalent chromium electroplating baths comprising dissolving in water:

a. a composition consisting essentially of
   i. borate ions present as a borate compound selected from boric acid and alkali metal and ammonium borate;
   ii. at least one alkali metal salt selected from sodium chloride, potassium chloride, sodium fluoride, potassium fluoride, sodium sulphate and potassium sulphate;
   iii. bromide present as a salt selected from sodium, potassium and ammonium bromide; and
   iv. an ammonium salt selected from ammonium chloride, ammonium fluoride, ammonium sulphate and said ammonium borate, said borate ions being present in a proportion of at least 1% of the total weight of the components *a, b, c* and *d*, said bromide being present in a proportion of at least 0.5%, measured as HBr of the total weight of the components *a, b, c* and *d*, said alkali metal salt being present in a proportion of at least 2% by weight of the dry weight of the composition, said ammonium salt being present in a proportion of from 5 to 80% by weight of the total weight of the components *a, b, c* and *d* in a proportion sufficient to provide at least 0.01 molar bromide and up to saturation;

b. sufficient of a trivalent chromium salt to provide of from 0.1 to 1.2 molar trivalent chromium;

c. sufficient of a water soluble formate to provide of from 2 to 1 moles of formate per mole of trivalent chromium; and adjusting the pH of the bath of a value of between 1 and 4.

27. A method according to claim 26 wherein the formate is ammonium formate.

28. A method according to claim 26 wherein the trivalent chromium salt is a basic trivalent chromium sulphate.

29. A method according to claim 26 wherein the bath is plated out for a total of 0.5 ampere hours per liter commencing not less than 12 hours after preparation of the solution.

30. A method according to claim 29 wherein the bath is plated out for at least 20 ampere hours per liter commencing not less than 12 hours after the preparation of the solution.

31. A method for the maintenance of a trivalent chromium electroplating bath which comprises adding thereto at separate intervals each of less than three days:

a. a composition consisting essentially of i. borate ions present as a borate compound selected from boric acid and alkali metal and ammonium borate;

ii. at least one alkali metal salt selected from sodium chloride, potassium chloride, sodium fluoride, potassium fluoride, sodium sulphate and potassium sulphate;

iii. bromide present as a salt selected from sodium, potassium and ammonium bromide; and iv. an ammonium salt selected from ammonium chloride, ammonium fluoride, ammonium sulphate and said ammonium borate, said borate ions being present in a proportion of at least 1% of the total weight of the components *a, b, c* and *d*, said bromide being present in a proportion of at least 0.5%, measured as HBr of the total weight of the components *a, b, c* and *d*, said alkali metal salt being present in a proportion of at least 2% by weight of the dry weight of the composition, said ammonium salt being present in a proportion of from 5 to 80% by weight of the total weight of the components *a, b, c* and *d* in an amount sufficient to maintain the concentration of bromide in the bath at least 0.1 molar.

b. a trivalent chromium salt in an amount sufficient to maintain the concentration of chromium in the bath between 0.1 and 1.2 molar.

c. a formate in an amount sufficient to maintain a concentration of formate in the bath from 1 to 2 moles per mole of trivalent chromium.

d. sufficient of an aqueous alkali to maintain the pH of the bath between 1 and 4.

32. An aqueous electroplating bath for electrodepositing chromium-iron alloys consisting essentially of water, from 0.2 to 0.6 molar trivalent chromium and iron cation in an amount up to saturation for the electrodeposition of chromium-iron alloys, from 0.05 to 0.3 molar bromide, from 2 to 1 moles formate per mole of trivalent chromium, from 0.2 to 3 molar ammonium, from 0.5 to 1 molar borate, from 2 to 4 molar total of anions selected from chloride and sulphate including at least 0.5 molar chloride and at least 0.5 molar sulphate and from 2 molar to saturation of alkali metal cations selected from the group consisting of sodium and potassium and having a pH of between 1 and 4.

* * * * *